US006642828B2

(12) United States Patent
Kvarnsjöet al.

(10) Patent No.: US 6,642,828 B2
(45) Date of Patent: Nov. 4, 2003

(54) AIRGAPPED MAGNETIC COMPONENT

(75) Inventors: Lars Kvarnsjö, Stockholm (SE); Johan Svedendahl, Hägersten (SE)

(73) Assignee: Emerson Energy Systems AB, Stockholm (SE)

( * ) Notice: Subject to any disclaimer, the term of this patent is extended or adjusted under 35 U.S.C. 154(b) by 0 days.

(21) Appl. No.: 09/948,116

(22) Filed: Sep. 6, 2001

(65) Prior Publication Data

US 2002/0039062 A1 Apr. 4, 2002

(30) Foreign Application Priority Data

Sep. 8, 2000 (SE) ..... 0003197

(51) Int. Cl.[7] ..... H01F 17/06
(52) U.S. Cl. ..... 336/178; 336/200; 336/212
(58) Field of Search ..... 336/200, 178, 336/83, 212, 223, 232

(56) References Cited

U.S. PATENT DOCUMENTS 3,792,399 A * 2/1974 McLyman ..... 336/210
4,356,468 A * 10/1982 van Laar ..... 336/69
4,603,314 A * 7/1986 Fukunaga et al. ..... 336/65
6,429,762 B1 * 8/2002 Shusterman et al. ..... 336/84 R

FOREIGN PATENT DOCUMENTS

| | | |
|---|---|---|
| EP | 0901136 A2 | 10/1999 |
| JP | 5082364 | 4/1993 |
| WO | WO98/11540 | 3/1998 |

* cited by examiner

*Primary Examiner*—Anh Mai
(74) *Attorney, Agent, or Firm*—Harness, Dickey & Pierce, P.L.C.

(57) ABSTRACT

A high frequency inductor includes a high permeability core, and at least one winding (6), having at least one winding layer (6). The core (2,3) exhibits at least one air-gap arranged within the at least one winding (6), whereat the at least one air-gap separates the core into at least two parts (2,3) and that a screen (14) is arranged around the at least one gap (4,4',4"), between the winding (6) and the gap (4,4'4"). The screen is essentially concentric with the winding, and has a width which is equal to or wider than the width of the at least one gap (4,4',4").

10 Claims, 8 Drawing Sheets

AIRGAPPED MAGNETIC COMPONENT

TECHNICAL FIELD OF THE INVENTION

The invention relates to high frequency magnetic components having high permeability cores and more specific high frequency inductors and the storing of energy therein.

For the purpose of this description the following words should be interpreted as follows: winding—one or more electrical conductors wound so as to be inductively coupled to a magnetic core.

BACKGROUND

Magnetic energy may be stored in magnetic components, i.e. inductors. The inductors may have cores made from high permeability material or low permeability. When storing magnetic energy in inductors having high permeability cores this requires at least one air-gap and/or several small air-gaps. The material in these high permeability cores may be made from e.g. ferrites, electrical steel, magnetic amorphous materials and magnetic nano-crystal materials. Penetration of fringing fields from the air-gap(s) will cause magnetic losses and also may result in damage to the device, such as hot spots etc.

One solution to the problem in the prior art is to use low permeability cores. The drawback with this solution is often expensive core(s) and problems with high current capacity.

The reason for using an air-gap/air-gaps is to avoid saturation of the core. The energy which is stored is proportional to the sizes of the air-gap. However, the magnetic field passes through he air-gap and the larger the air-gap is, the more this field will bulge outside from the air-gap volume as such, so called fringing fields. This will cause winding losses since the current will be distorted in the winding. In order to minimize these effects the winding may be distanced from the air-gap(s) e.g. by winding one or more layers f plastic foil closest to the air-gap(s) in order to separate the winding from the core. This is bad utilization of the winding window.

Another way of solving this problem is to divide the air-gap into several air-gaps or to cool the component.

Further, if the air-gap is larger, this may cause electromagnetic compatibility (EMC) problems. Ways to solve this problem in the known technique is to use copper strips in the winding instead of using copper wires or to make the air-gap smaller.

SUMMARY OF THE INVENTION

The present invention relates to a high frequency inductor of the type having a high permeability core with one or more air-gaps.

The present invention seeks to provide a high frequency inductor of the above type in which the drawbacks mentioned above are diminished.

In order to solve the above mentioned problems the inductor according to the invention exhibits a metal screen for reducing the penetration of the high frequency electromagnetic fringing field from the air-gap(s) into the winding. As a result the winding window can be fully utilized.

According to the invention copper wire may be used in the winding instead of copper strip, since the screen reduces the effect of the fringing field. The screen will protect the winding from hotspots and radiated EMI.

According to the invention the screen makes it possible to build the winding as layers of equal turns of wound wire connected in parallel. Typically an inductor conducts a DC/low frequency current with a superposed AC current. Due to the skin and the proximity effects the AC part of the current will be conducted by a conductor forming the inner winding layer. The inner layer can therefore be optimized for low AC losses. The DC part of the current will be shared by all the conductors in the winding by the principle of lowest electrical resistance. For lowest DC resistance the winding can therefore have as many parallel layers as the space allows, which implies high current capacity. The conductors in the DC part of the winding may also be wound all at the same time, giving a mix of those conductors in the outer layers.

Parallel winding layers without a screen have the drawback of circulating currents between the layers, caused by the high frequency fringing field from the air-gap(s).

Further according to the invention, by using winding layers connected in parallel a low total capacitance is obtained for the inductor.

A high frequency inductor according to the invention thus has a number of advantages. Among these are the possibility of storing more energy on account of the larger air-gap being shielded by the metal screen which is made possible without detrimental effects to the windings. Further, by providing separate AC and DC/low frequency parallel winding layers high current capacity and low capacitance are attained.

BRIEF DESCRIPTION OF THE DRAWINGS

The invention will now be described by way of example and with reference to the accompanying drawings in which:

In the figures like details and parts are designated with the like reference numbers throughout the drawings.

In FIG. 1 a high permeablity core 1 is shown. The core is formed in two halves 2, 3 and each half has the shape of the letter "E", i.e., an elongated member having three perpendicular members, two longer at the ends of the elongated member and one shorter situated halfway between the other two, all three co-planar. This has as a result that the shorter perpendicular embers of the core form a gap 4. This gap is where the magnetic energy is stored. The core may also exhibit the form of a "C" or a "U" or other conceivable forms in which a g p may be formed. The "C" or a "U" will then constitute the one half of the core and b accompanied by another core part. Since the core is formed as two parts placed adjacent to each and forming mirror images of each other there will of course, as ca be seen in the figure exist two joints 17' and 17".

In FIG. 2 the core 1 is shown with a bobbin 5 placed therein. The windings 6 of the inductor are indicated. One of the end pieces 7 of the bobbin is shown having contact pins $\mathbf{8}^{in}$, $\mathbf{8}^{out}$ one for each winding and contact pins $\mathbf{9}^{in}$, $\mathbf{9}^{out}$ for connecting the conductors to each other in parallel. Alternatively like contact pins may be arranged on the opposite end piece and either one of the contact pins for in and out may be place on either of the two end pieces (not shown).

In FIG. 3 an exemplary arrangement of the contact pins and windings on the end piece 7 of the bobbin 5 is shown. Contact pins $\mathbf{8}^{in}$, $\mathbf{8}^{out}$ one for each winding and contact pins $\mathbf{9}^{in}$, $\mathbf{9}^{out}$ for connecting the conductors to each other in parallel. Also the conductors 10, 11, 12, 13 are indicated. Conductor 10 is the conductor for the AC (high frequency) and the conductors 11–13 are the conductors for DC/low frequency. The dimensions of the conductors in the winding and their characteristics may be decided on by the man skilled in the art. Generally they should be chosen as to give the lowest possible losses.

In FIG. 4 an embodiment of the inductor according to the invention is shown in a plan view perpendicular to the view in FIG. 2. In the figure is shown the core halves 2 and 3 and the bobbin 5 is shown partly covered by the windings 6. The end piece 7 with the contact pins $\mathbf{9}^{in}$, $\mathbf{9}^{out}$ for connecting the conductors to each other in parallel. A conductor 15 is shown which connects all the contact pins $\mathbf{9}^{out}$, as well as a conductor 16, which connects all the contact pins $\mathbf{9}^{in}$, contact pins $\mathbf{8}^{in}$, $\mathbf{8}^{out}$ one for each winding are also indicated (partly hidden). The conductors 15 and 16 are indicated for the sake of clarity. The coupling of the parallel windings are preferably made in the printed circuit board normally as the inductor preferably is manufactured as a surface mounted component.

In FIG. 5 the inductor according to the above embodiment is shown in a section along B—B in FIG. 6. The location of the section B—B means that the section cuts through the inductor so that the winding is seen in a cross-sectional view. The winding consists in this example of four wound layers 10,11,12,13, where the layers are connected in parallel. The AC part of the current will be conducted by the inner layer 13, while all the layers will share the DC/low frequency part of the current. In this example all wires have equal width, but each layer may also be optimized for low AC and DC conduction losses. This optimization is something the man skilled in the art will be able to do performing any type of inventive work. Also seen is the core 2, and 3, the gap 4 the bobbin 5 and the screen 14.

In FIG. 6 the inductor according to this embodiment is shown in a section along A—A in FIG. 4. Sections of one half of the core 3 is seen on both sides of an indicated winding 6.

The location of the section A—A means that the section cuts right through the air-gap 4 formed in the core. The winding 6 is wound on a bobbin 5 and in-between the bobbin 5 and the winding 6 a metal screen 14 is arranged in order to reduce the penetration of the high frequency electromagnetic fringing field from the air-gap 4 into the winding.

The metal screen is preferably made from copper but any material with equivalent or similar characteristics as to electrical characteristics could equally well be used. Specifically, the screen 14 is preferably made from a material exhibiting a high conductivity of at least $1\times10^6$ siemens. The purpose of the screen is to protect the winding from the high frequently fringing field. In the screen (as in windings if the screen was not present) the time-varying magnetic flux will result in an emf (electromotive force) being induced in accordance with Faraday's Law. The emf will produce local currents in the screen which will cancel or almost cancel the fringing field into the winding. The screen ill marginally effect the static or low frequency magnetic field. The losses in the winding without a screen present and with this size of an air-gap may be so substantial as to even destroy the windings at least partly.

Figure 1:
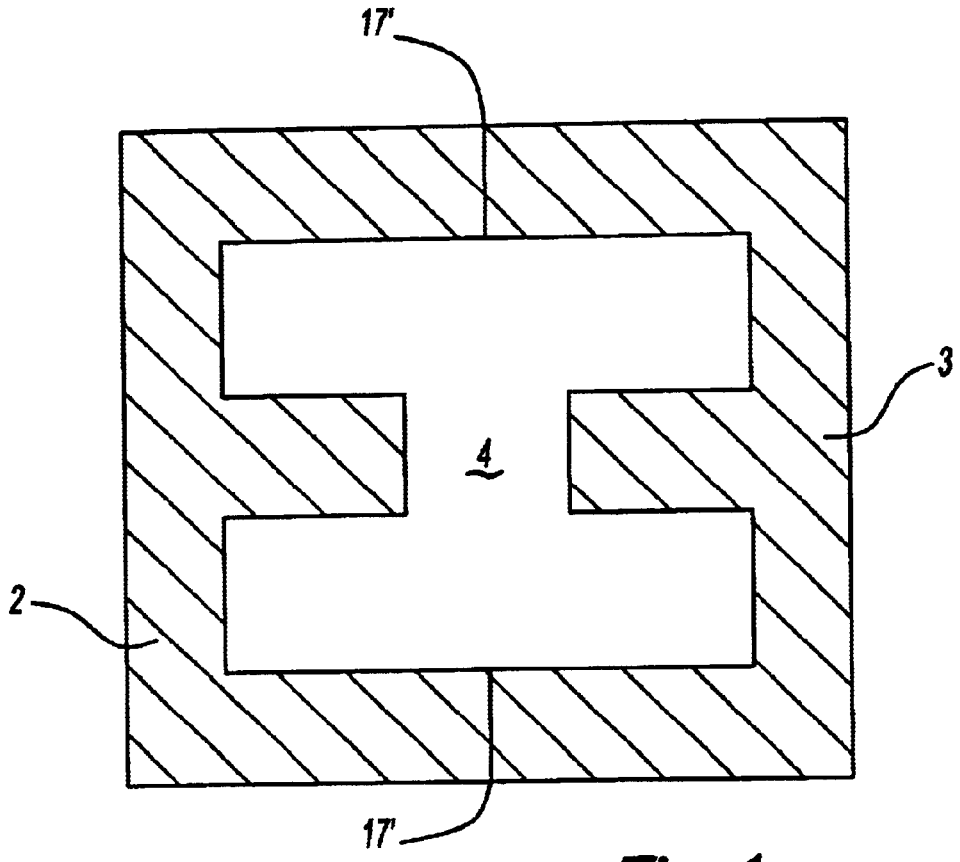
FIG. 1 shows one embodiment of a high permeability core of the type used according to the invention.
Figure 2:
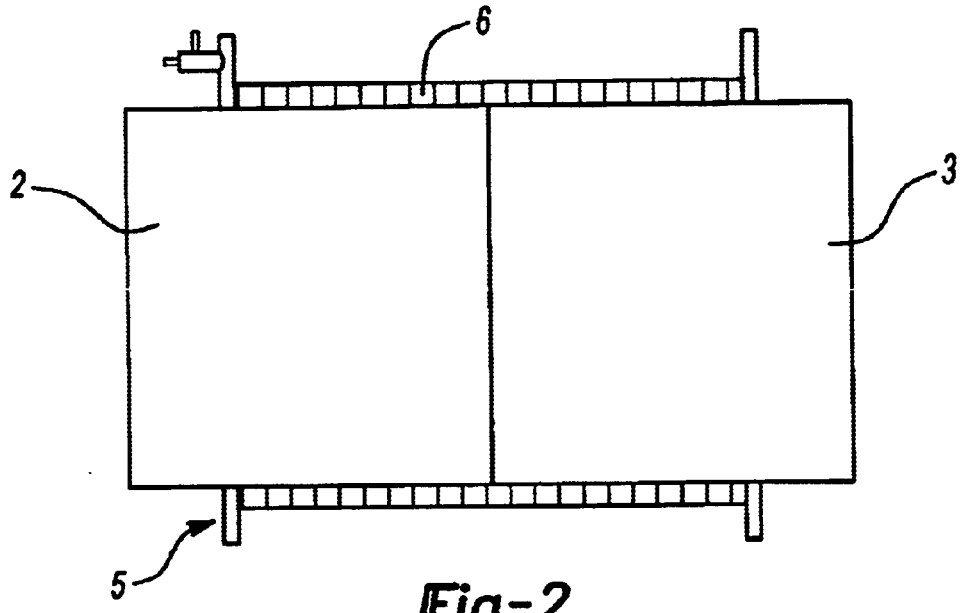
FIG. 2 shows the core shown in FIG. 1 in a side view with a bobbin and windings placed therein.
Figure 3:
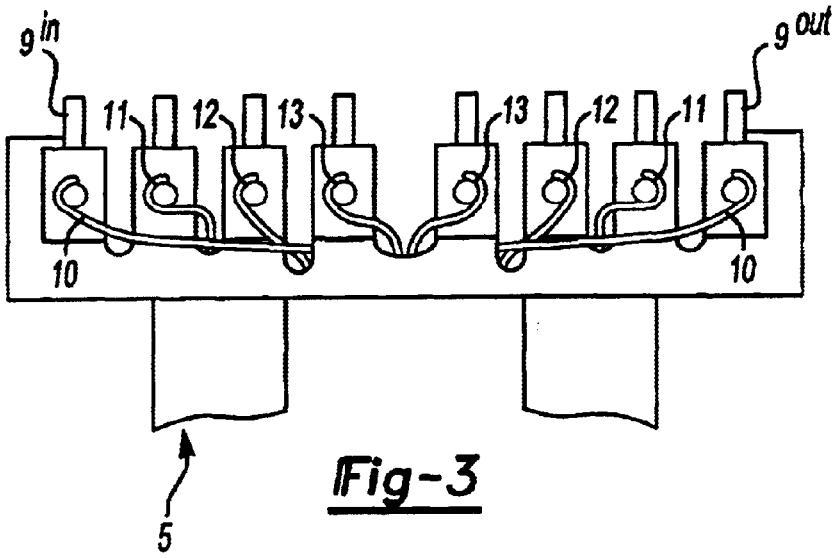
FIG. 3 shows the arrangement of the contact pins and windings on the end piece of the bobbin.
Figure 4:
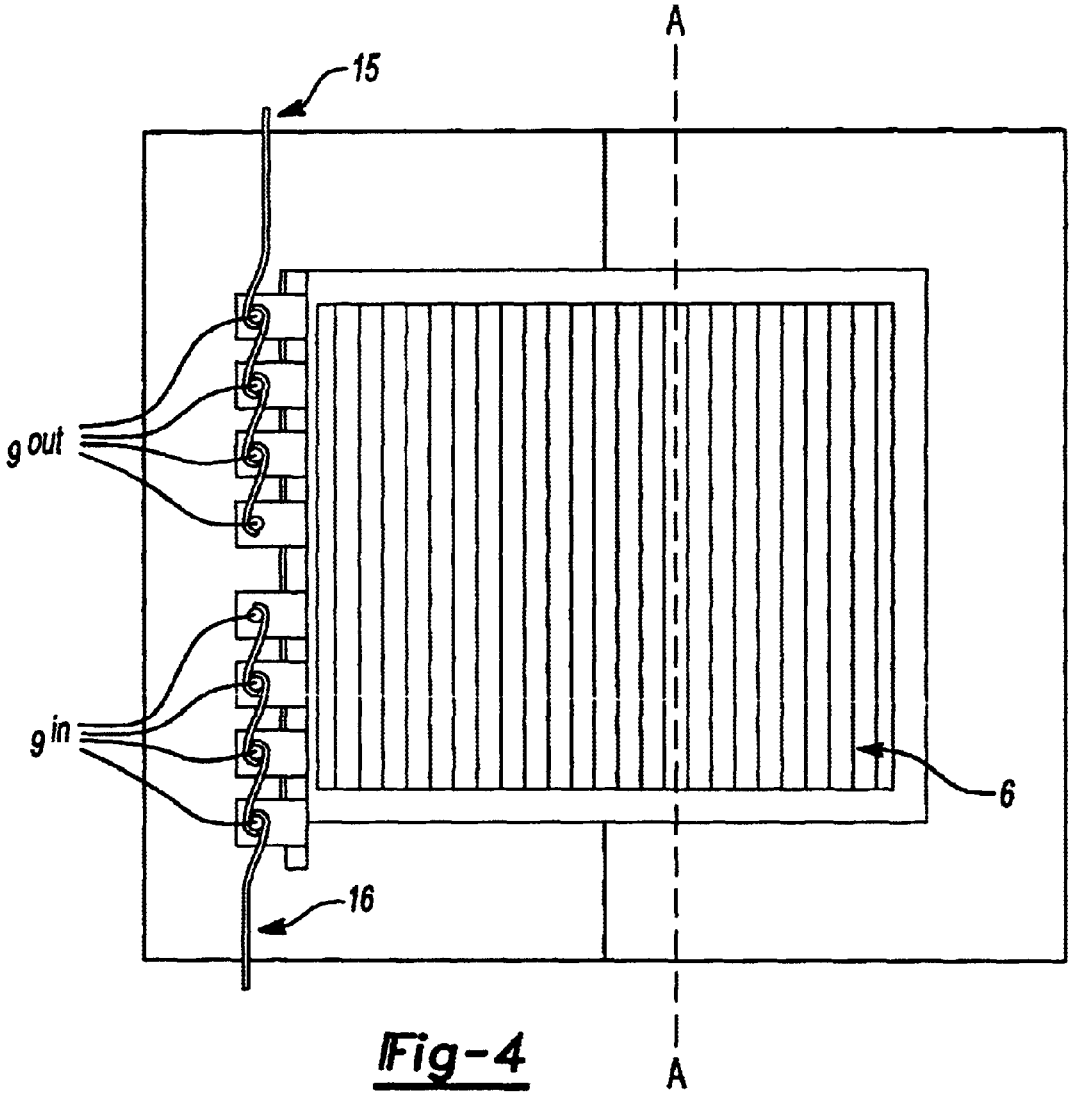
FIG. 4 shows the inductor according to the invention in a plan view perpendicular to the view in FIG. 2.
Figure 5:
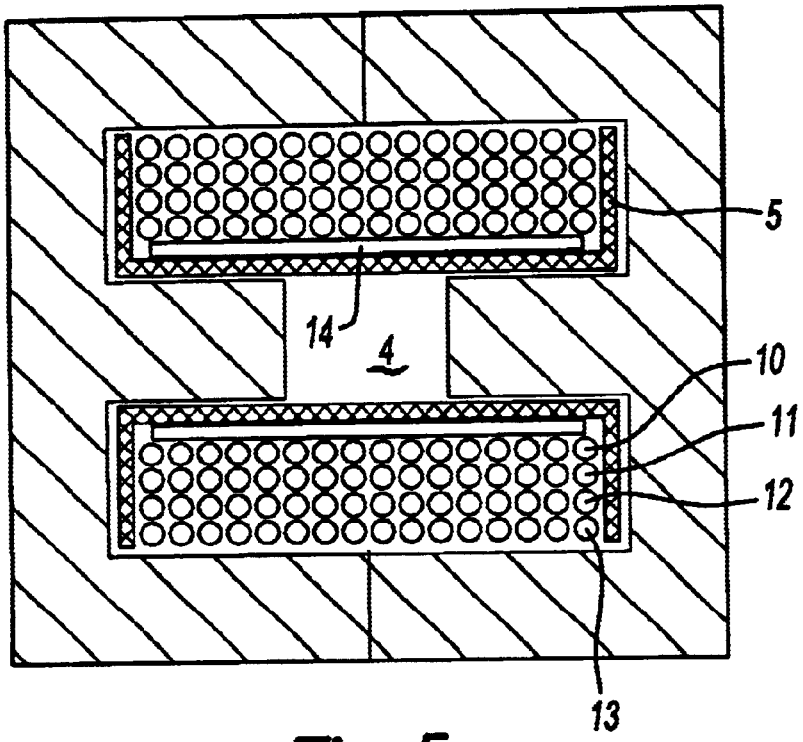
FIG. 5 shows a section along B—B in FIG. 6.
Figure 6:
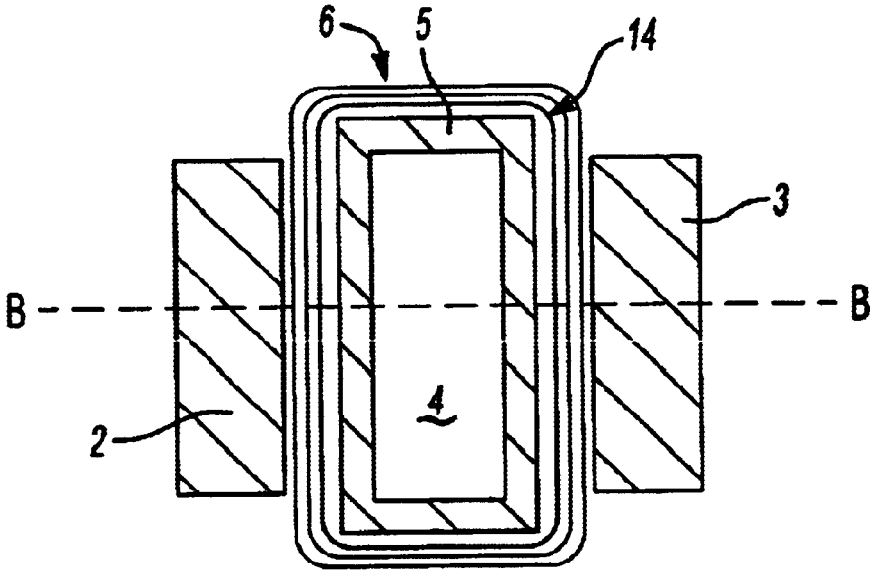
FIG. 6 shows a section of an exemplary inductor according to the invention in a section corresponding to A—A in FIG. 4.
Figure 7:
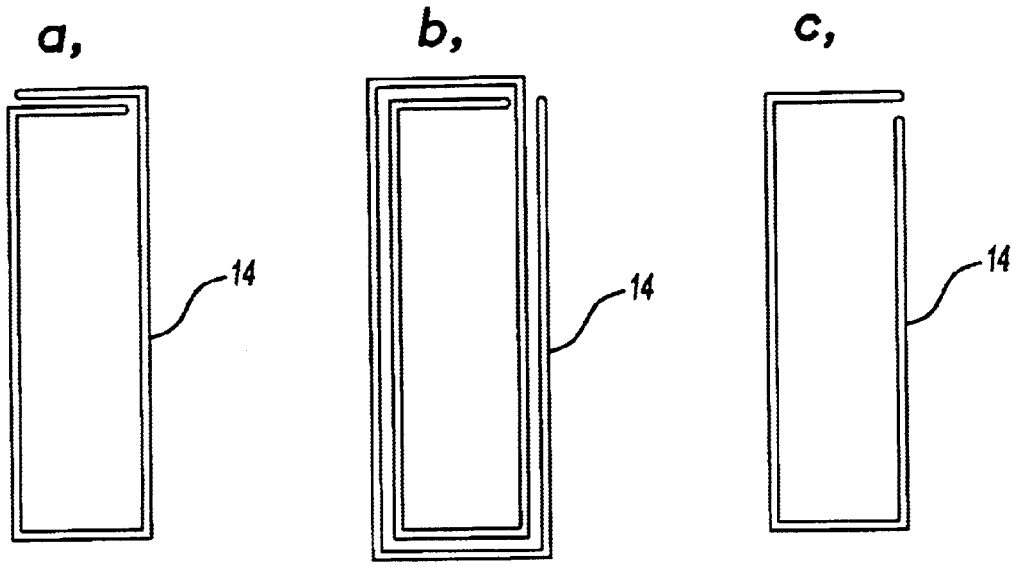
FIGS. 7*a–c* shows three different embodiments of the screen according to the invention.

In FIGS. 7*a–c* three different embodiments of the metal-screen 14 is shown in section. The screen may exhibit a thickness of e.g. somewhere around 0.25 mm. A thickness of 0.1 mm seems to be too little at present. The thickness of the screen is, however, something the man skilled in the art should be able to decide on. The screen in FIG. 6*a* will be sufficient for its purpose, the one in FIG. 6*b* will add to the effect of the screen and the one in FIG. 6*c* will not be quite as sufficient. The width of the screen should be so long as to well cover the whole gap between the two short members of the core. However, the screen may also be as wide as to cover the entire width of the winding.

The screen will thus allow air gaps in the core to be substantially wider than in a inductor without such a screen.

Figure 8:
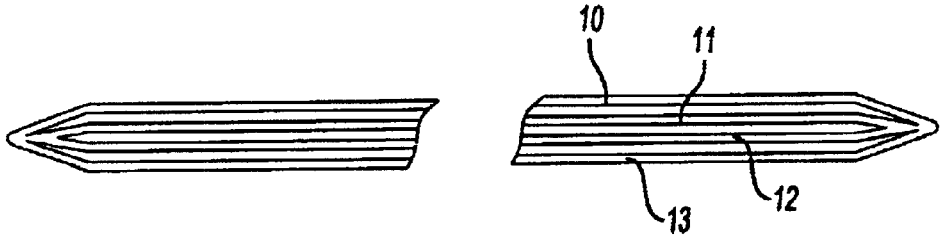
FIG. 8 shows an example of the windings used according to the invention.

In FIG. 8 is shown an example of how the windings may be arranged according to the invention. According to one embodiment according to the invention a conductor 10 of smaller dimensions will be wound around the bobbin as the innermost layer/layers and thereafter the three conductors 11, 12, 13 of a bigger dimension are connected in parallel and wound around the core simultaneously. This will give the conductors approximately the same length. Examples of the conductor dimensions are 0.05 and 2 $mm^2$, respectively.

Figure 9:
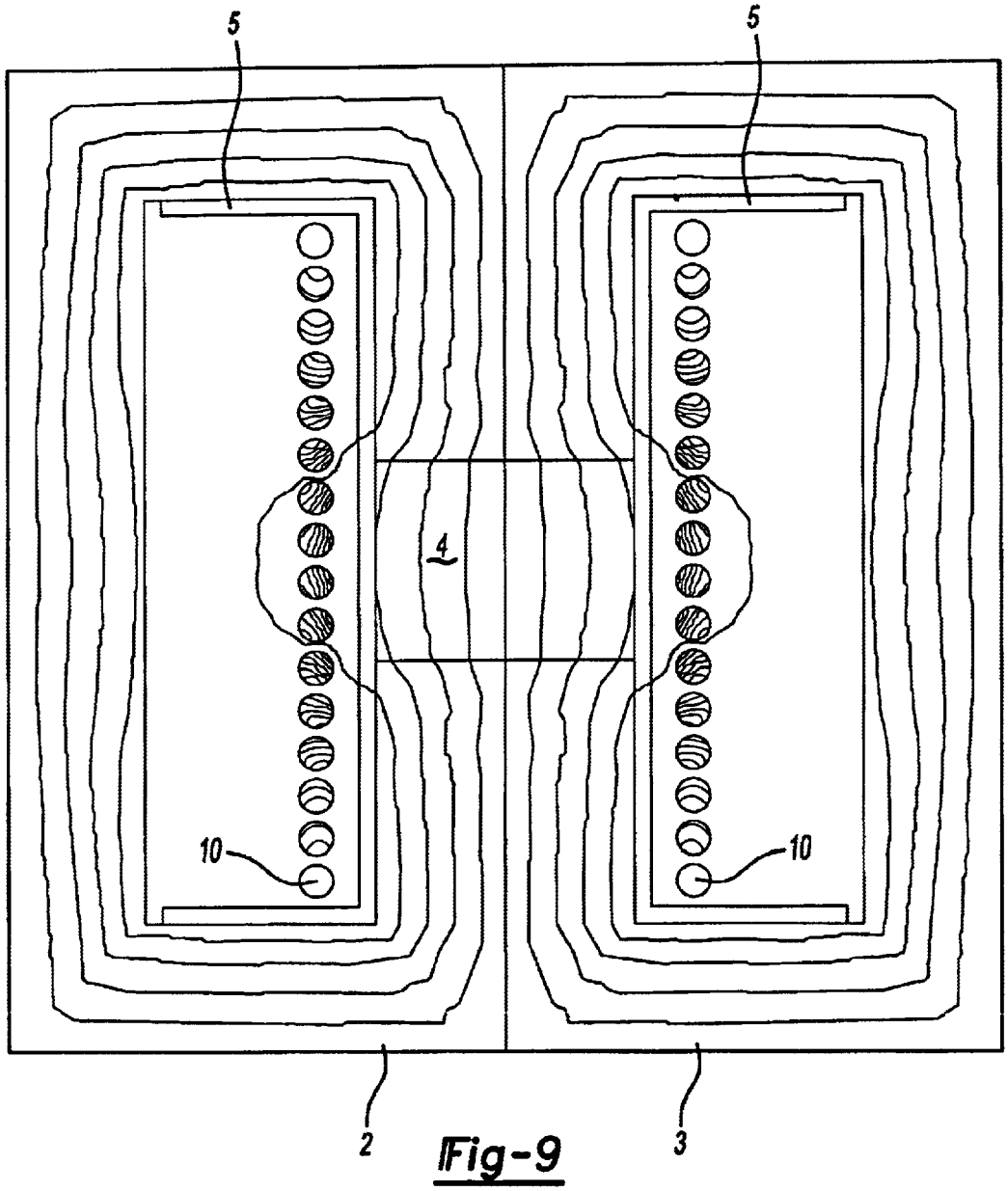
FIG. 9 shows in a FEA-simulation an example of the flux through the ferrite core without the screen.

In FIG. 9 a FEA-simulation is shown in which may be seen that without a screen the current in the wires will have a non-uniform current distribution on account of the fringing field. In the figure is also indicated the core 2,3, the gap 4, the bobbin 5, and the inner layer of the winding 10.

Figure 10:
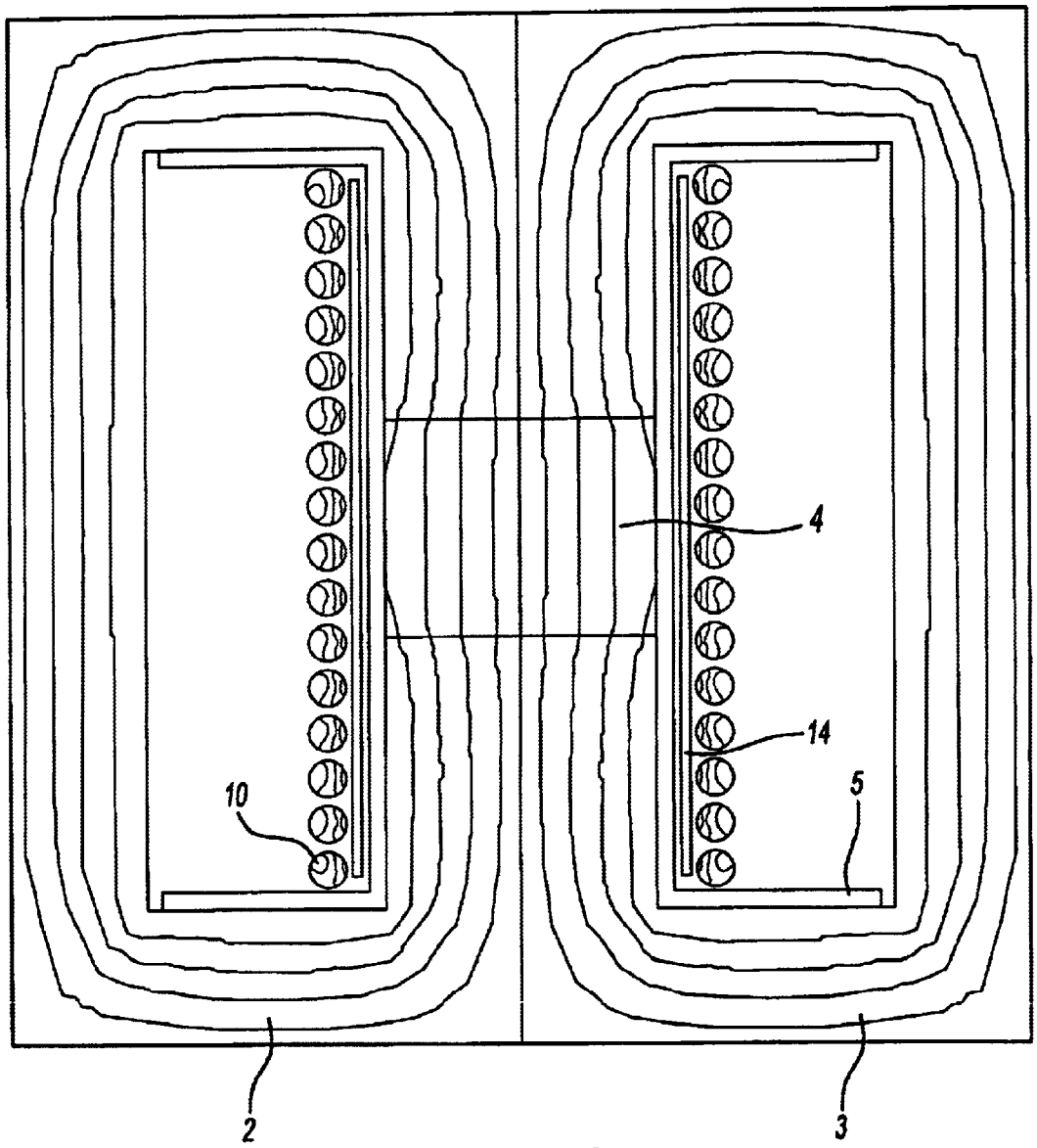
FIG. 10 shows in a FEA-simulation an example of the flux through the ferrite core with the screen.

In FIG. 10 a FEA-simulation is shown in which may be seen that the high frequency flux will not penetrate the winding on account of the screen and a more uniform current distribution is arrived at. When the winding is protected from the air-gap flux, parallel winding layers can be used. Because of proximity loses in the winding the inner winding layer will carry the high frequency current. The DC or low frequency current will be shared between the windings in accordance with the resistance of each conductor in the winding.

In the figure is also indicated the core 2,3, the gap 4, the bobbin 5, the screen 14, and the inner layer of the winding 10.

Figure 11:
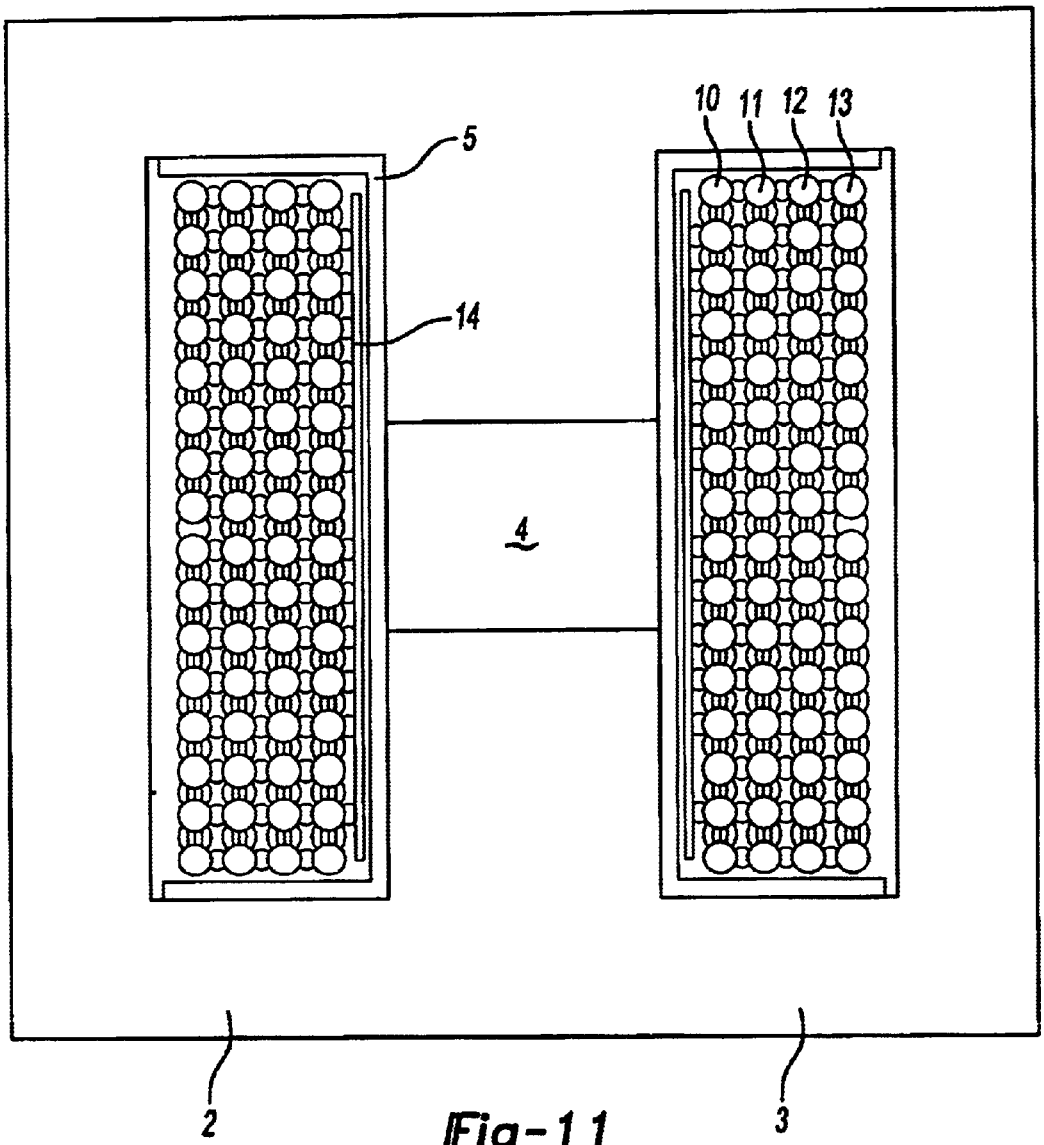
FIG. 11 shows in a FEA-simulation an example of the electrical field inside the winding.

In FIG. 11 a FEA simulation showing the electrical field inside the winding. The different layers have the same change of potential for each turn. With this winding technique the difference in potential between adjacent wires is minimized, resulting in low capacitance. This can be seen by the few field lines between the layers.

In the figure is also indicated the core 2,3, the gap 4, the bobbin 5, the screen 14, and the four layers of the winding 10,12,13,14.

Figure 12A:
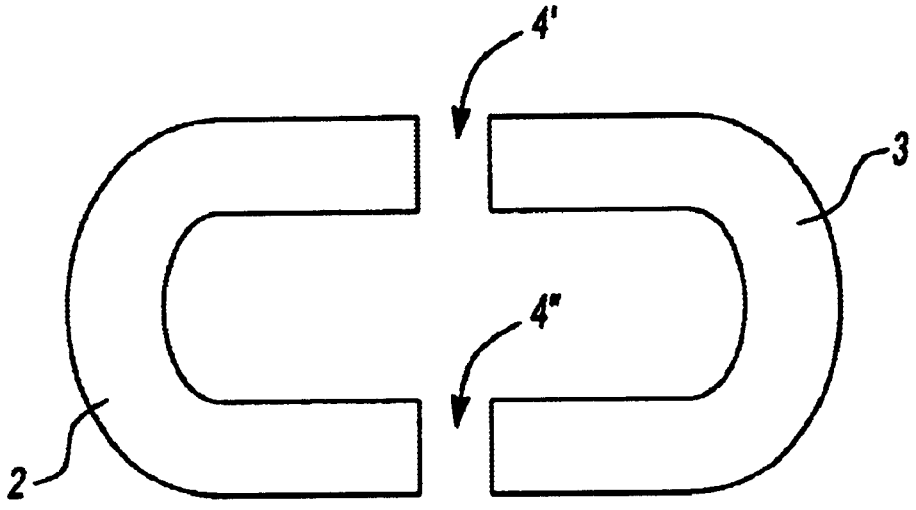
FIG. 12 shows a second exemplary embodiment of an inductor according to the invention.
Figure 12B:
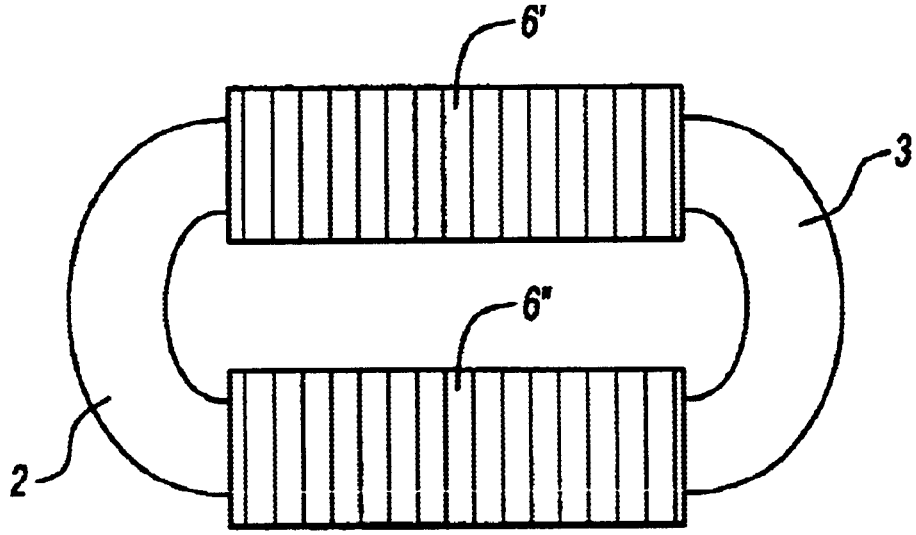

In FIGS. 12*a* and *b* a second exemplary embodiment is shown schematically. The core halves have the form of a "U" placed as to form a mirror image with the axis of rotation parallel to the two ens of the "U". Between the two "U":s two gaps 4' and 4" are shown. In FIG. 12*b* the core halves 2 and 3 is seen in the same arrangement as in FIG. 12*a*. The gaps 4' and 4" and most of the straight part of the legs of the "U" are shown covered with windings 6' and 6".

The windings are essentially built in the same manner as that of the first embodiment, i.e. the winding is arranged on a bobbin (not shown) and between the bobbin and the winding the screen (not shown) according to the invention is placed.

The high frequency inductor according to the invention thus allows the use of the special winding technique described above and the separation of the AC and DC parts of the currents.

This gives the advantage of optimizing the different conductors for the specific type of current conducted by the same. In this way the losses can then be substantially reduced. The other part of the winding carrying the DC or low frequency current can then also be optimized for its current and the winding losses in total will be reduced.

By using the screen according to the invention the winding window will be fully utilized and smaller components and less material may be used.

Further the use of the metal screen will increase the possibility of storing magnetic energy in inductors exhibiting air-gaps(s) substantially.

From the foregoing it will be recognized that the principles of the invention may be employed in various arrangements to obtain the benefits of the many advantages and features disclosed. It is to be understood that, therefore, that even though numerous characteristics and advantages of the invention has been described in connection with the exemplary embodiments, this disclosure is to be considered illustrative only. Various changes and modifications may be made without departing from the spirit and scope of the invention as defined by the claims. The entire disclosure of Swedish Patent Application No. 0003197-1 filed Sep. 8, 2000 is incorporated by reference herein.

What is claimed is:

1. A high frequency inductor comprising:

a high permeability core; and at least one winding having at least one winding layer;

wherein the core includes at least one air-gap arranged within the at least one winding, said at least one air-gap separating the core into at least two parts and wherein a screen is arranged around the at least one air-gap, between the winding and the air-gap, the screen being essentially concentric with the winding, said screen having a width which is equal to or wider than the width of the at least one air-gap, said screen being made from a material exhibiting high conductivity and arranged so as to cause local currents in the screen, thereby essentially reducing the effects of fringing fields caused by the at least one gap.

2. The inductor according to claim 1, wherein the winding is arranged on a bobbin.

3. The inductor according to claim 2, wherein the screen is arranged on said bobbin between the bobbin and the winding.

4. The inductor according to claim 1, wherein the screen is made from a material exhibiting a conductivity of at least $1\times10^6$ siemens.

5. The inductor according to claim 1, wherein the screen is made from copper or copper alloy.

6. The inductor according to claim 1, wherein the screen forms at least one layer with an overlap around the air-gap.

7. The inductor according to claim 1, wherein the screen forms two layers with an overlap around the air-gap.

8. The inductor according to claim 1, wherein the winding layer comprises at least two groups of conductors, a first group comprising at least one conductor, and a second group comprising at least one conductor, the conductors of said second group being in parallel, said first group arranged outside and concentric with said screen, and said second group arranged outside and concentric with said first group.

9. The inductor according to claim 8, wherein the first group of conductors are adapted to carry high frequency current and said second group of conductors are adapted to carry low frequency current.

10. The inductor according to claim 1, wherein said screen is ungrounded.

* * * * *

UNITED STATES PATENT AND TRADEMARK OFFICE

CERTIFICATE OF CORRECTION

PATENT NO. : 6,642,828 B2
DATED : November 4, 2003
INVENTOR(S) : Lars Kvarnsjö et al.

It is certified that error appears in the above-identified patent and that said Letters Patent is hereby corrected as shown below:

Column 1,
Line 32, “he” should be -- the --.
Line 38, “f” should be -- of --.

Column 2,
Line 60, “permeablity” should be -- permeability --.
Line 66, “embers” should be -- members --.

Column 3,
Line 2, “g p” should be -- gap --.
Line 3, “b” should be -- be --.
Line 6, “ca” should be -- can --.

Column 4,
Line 7, “ill” should be -- will --.
Line 9, “winding” should be -- windings --.

Column 6,
Line 20, after “or” insert -- a --.

Signed and Sealed this

Twenty-second Day of June, 2004

JON W. DUDAS
*Acting Director of the United States Patent and Trademark Office*